US005674168A

United States Patent [19]

Wilkinson

[11] Patent Number: 5,674,168

[45] Date of Patent: Oct. 7, 1997

[54] MULTIPLE EXERCISE DEVICE

[76] Inventor: William T. Wilkinson, Sunset Dr., R.D. #1, Salem, N.J. 08079

[21] Appl. No.: 480,645

[22] Filed: Jun. 7, 1995

[51] Int. Cl.[6] ..... A63B 21/00

[52] U.S. Cl. ..... 482/138; 482/72; 482/115; 482/123; 482/126; 482/137; 482/140; 482/142; 482/145

[58] Field of Search ..... 482/72, 73, 95, 482/96, 92, 101, 114, 115, 118, 126, 121–124, 129, 130, 135, 137, 138, 142; 601/24, 35

[56] References Cited

U.S. PATENT DOCUMENTS

| | | | |
|---|---|---|---|
| 339,638 | 4/1886 | Goldie | 482/96 |
| 682,988 | 9/1901 | Hazelip | 482/96 |
| 1,623,670 | 4/1927 | Frankenfeld | 482/123 |
| 1,738,987 | 12/1929 | Dattilo | 482/130 |
| 2,783,045 | 2/1957 | Bosch | 482/96 |
| 3,709,487 | 1/1973 | Walker | 482/142 |
| 3,892,404 | 7/1975 | Martucci | 482/96 |
| 4,198,044 | 4/1980 | Holappa | 482/142 |
| 4,383,684 | 5/1983 | Schliep | 482/96 |
| 4,720,099 | 1/1988 | Carlson | 601/35 |
| 4,796,881 | 1/1989 | Watterson | 482/130 |
| 5,007,632 | 4/1991 | Wilkinson | 482/131 |
| 5,066,005 | 11/1991 | Luecke | 482/96 |
| 5,125,884 | 6/1992 | Weber et al. | 482/142 |
| 5,169,363 | 12/1992 | Campanaro et al. | 482/96 |
| 5,176,603 | 1/1993 | Hundley et al. | 482/140 |
| 5,374,225 | 12/1994 | Wilkinson | 492/29 |

FOREIGN PATENT DOCUMENTS

| | | | |
|---|---|---|---|
| 289896 | 2/1966 | Australia | 482/137 |
| 2643821 | 9/1990 | France | 482/73 |
| 320498 | 4/1920 | Germany | 482/72 |
| 1818112 | 5/1993 | U.S.S.R. | 482/123 |
| 2194455 | 3/1988 | United Kingdom | 482/96 |

*Primary Examiner*—Richard J. Apley
*Assistant Examiner*—Victor K. Hwang
*Attorney, Agent, or Firm*—Connolly & Hutz

[57] ABSTRACT

A multiple exercise device includes a slant board which may be elevated to different angular orientations ranging between completely vertical to completely horizontal. A rowing arm assembly is mounted on each side of the slant board with the pivotal action of the rowing arms being resisted by a friction brake. A foot platform is mounted at the lower end of the slant board and a shoulder resistance assembly is also mounted to the slant board.

38 Claims, 6 Drawing Sheets

MULTIPLE EXERCISE DEVICE

BACKGROUND OF THE INVENTION

Various types of exercises exist for developing the lower body and the upper body. For example, knee bends or squats are considered as one of the best exercises for developing the lower body, particularly, the legs and the buttocks. Such forms of exercise are also advantageous because they are low impact exercises which are aerobic. One of the most effective exercises for developing the upper body, particularly the back, shoulders, arms and chest is rowing.

It would be desirable if a device could be provided which enables the user to perform both lower body and upper body exercises so as to thereby result in total body, aerobic and strength exercises.

SUMMARY OF THE INVENTION

An object of this invention is to provide a total body/dual action exercise device that is capable of working both the upper and the lower body at the same time or separately. Such total body/dual action exercise would work both the upper body and the lower body at the same time so as to be the best possible aerobic and strengthening type activity.

In accordance with this invention a multiple exercise device comprises an elongated slant board for supporting the body of the user. A support frame is mounted to the slant board for elevating one end of the slant board to a plurality of selected positions and thereby vary the inclination of the slant board. A rowing arm is pivotally mounted on each of the opposite sides of the slant board with each rowing arm incorporating a resistance assembly to resist the pivoting motion as the user grasps and pivot the rowing arms. Alternatively, or in addition stretch cords may be provided for the arm exercise. The slant board is utilized as an aid in the user performing lower body exercises, such as knee bends or squats.

A BRIEF DESCRIPTION OF THE DRAWINGS

FIG. 1 is a top plan view of the device shown in FIG. 2;

DETAILED DESCRIPTION

Figure 2:
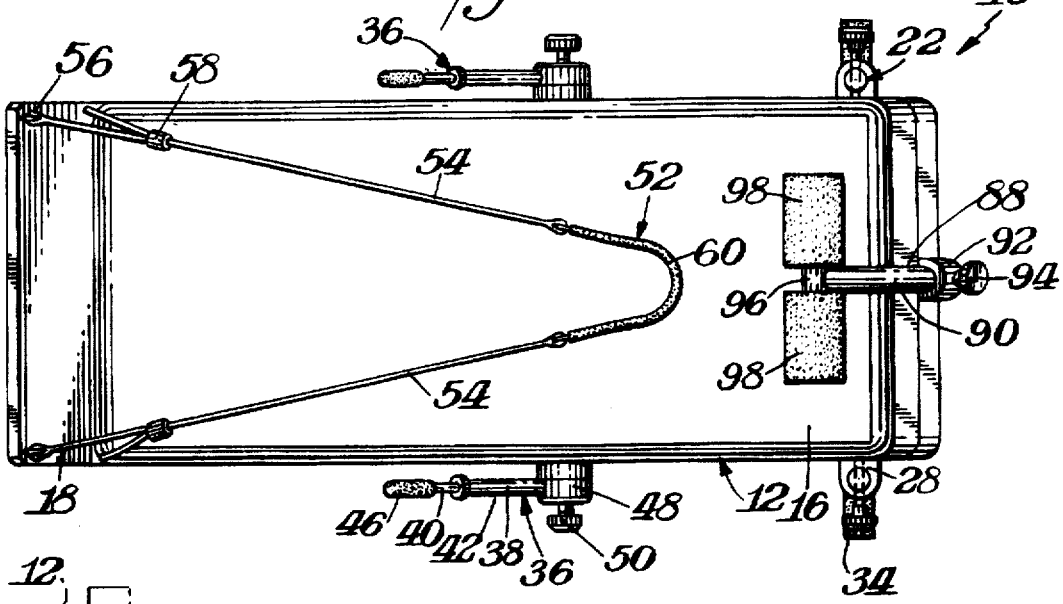

The invention combines an arm exercise device(s), preferably a rowing mechanism, with a knee bend device, preferably a padded slant board, into one unit, to create a new total body, aerobic and strength exercise unit, all in one. The load or resistance on both the upper and lower body can be adjusted or varied, to achieve different levels of exercise for the user.

Knee bends require balance, particularly when standing straight up from a flat footed position on the floor, with nothing to hold on to. This exercise is further made difficult by having to lift and bear the body's entire weight when standing straight up.

The invention solves this problem by using a slant board (preferably padded for comfort) against which the user can support or rest the back, while doing repetitive knee bends, thus achieving better balance and comfort.

The angle of the slant board is also preferably adjustable, so that the user can vary the amount of his body weight that he lifts. The slant board is also preferably stationary, but can also move and slide up and down. Also, there can be a combination of a stationary section(s), and a sliding section (s). The slant board can also have devices to add resistance or weight for knee bends, such as weights, springs, friction brakes, hydraulic or pneumatic cylinders, elastic bands or cords, pulleys, weight belts, vests, harnesses, etc.

These resistance devices can be attached to or contact various points on the body or the slant board. They can also be used separately or in combination.

A weighted waist belt or vest or a shoulder harness, example, could be worn. Elastic bands could be attached to the base of the slant board, and then attached or contact to the waist or shoulders. The elastic bands could also be held in the hands.

Another way is for the board to have padded shoulder pieces, and slide up and down on a shaft or track, as the user stands up. The sliding board could have parts to hold weights, or pull against springs or elastic cords attached to the base.

Preferably the user wears a padded shoulder harness or belt with elastic cords that can be attached to the base. Preferably the length of the elastic cords can be adjusted to easily vary the tension or resistance against which the user must work.

The slant board can also have a foot board or platform or feet at the bottom for the user to stand on and achieve better balance when pushing off to do knee bends or squats.

The top of the slant board can be equipped with a piece to engage or anchor the feet or legs, so the board can be used to do situps to exercise the abdominal, and hyperextensions for the lower back.

UPPER BODY

The slant board is also equipped with an upper body or arm exercisers, preferably a rowing device, with an adjustable resistance means, such as weights, springs, pulleys, elastic cords, hydraulic or pneumatic cylinders, but preferably independent friction brake mechanisms. The slant board can also have other upper body exercise devices, such as a bar or handles, attached to resistance cords or bands for presses, pullovers, curls, flys, etc.

The slant board preferably is equipped with an adjustable angle support or frame. The support and frame also have one or more feet, (preferably one or two) that give the slant board stability. The support frame or feet can be adjustable in either or both a horizontal and vertical direction. The angle of the slant board can be changed by use of a spring pin, knob screw, pull pin, that controls the angle of the slant board, as it pivots on the joint that joins it to the support frame.

The slant board could be capable of being positioned anywhere between a completely upright or vertical position, to a completely prone or horizontal, or even below the horizontal position.

OPERATION

The user adjusts the angle of the slant board where it is comfortable for him. The user then begins to do deep knee bends. As he goes or slides downward with his back against the padded slant board, his arms move the rowing arms forward. As the user moves in an upward direction, to a standing position, the rowing arms are pulled in an upward direction.

In this way, the user performs a powerful aerobic motion. Multiple repetitions will create tremendous aerobic activity and muscle building activity, at the same time, for the entire body. Yet the motion is low impact, and the body is safely balanced. Also the back is given excellent support. Performing sit ups, hyperextensions gives an additional workout for the mid section, back and abdominals.

Because the exercise is manual, and not motorized, the user is always in control and thus it is safer. The adjustable angle of the slant board lets the user achieve a comfortable position that controls the amount of gravity load on the hips, knees and ankle joints, which are prone to injury. The adjustable resistance settings on the arms lets the user control the load on the upper body, again producing a highly customized safe workout. Additional resistance from belts or harnesses, allow careful distribution of weight on the back.

It is believed that because this exercise moves the legs and buttocks through the greatest range of motion and utilizes the arms at the same time under resistance, that this produces an aerobic and strengthening exercise superior to any other form, in a very safe low impact fashion.

PREFERRED EMBODIMENTS

FIGS. 1–4 illustrate a multiple exercise device 10 in accordance with one embodiment of this invention. As shown therein the exercise device 10 includes a slant board 12 which is intended to support the user. The slant board could take any suitable form and might, for example, include a pair of side supports 14 which are spanned by a padded mat 16. Alternatively, the slant board could be a one piece solid member which may or may not have a pad thereon.

Figure 1:
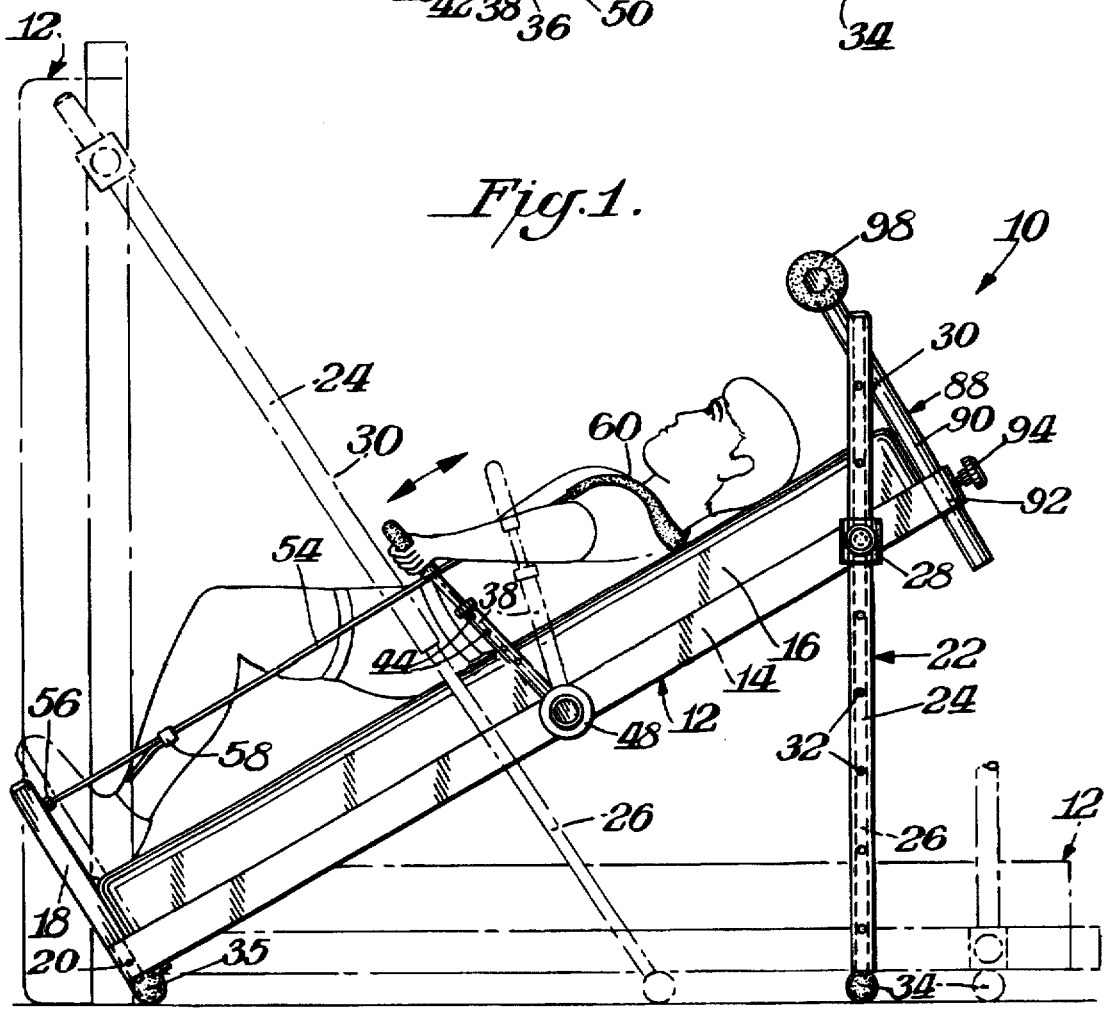
FIG. 1 is a side elevational view of a multiple exercise device in accordance with this invention showing the device in various positions.

Preferably, the lower or foot end of the slant board has a foot board or platform 18 mounted thereto. As shown in FIG. 1 footboard 18 is detachable in any suitable manner such as by the provision of a pin 20 which extends through support 14 and engages a corresponding opening in footboard 18. A similar pin would be located on the opposite side of slant board 12. The amount of extension of footboard 18 may be varied by inserting pins 20 into one of a selected number of openings 21 similar to the manner of adjusting the elevation of slant board 12 with respect to frame 22. As illustrated in various figures the footboard 18 is perpendicular or at least generally perpendicular to slant board 14 and extends outwardly beyond the padded portion 16 to provide a stationary member against which the user may place his feet. Preferably the footboard 18 extends completely across slant board 12. The invention, however, may be practiced by having the footboard 18 of smaller size or by having two individual footboards each located for a respective foot.

Slant board 12 may preferably be elevated or lowered to different positions. In the preferred practice of the invention the range of the position would vary from a completely vertical position as shown in phantom in the left hand portion of FIG. 1 to a completely horizontal position as also shown in phantom in FIG. 1. If desired these positions could range beyond the vertical and beyond the horizontal. The manner of elevating slant board 12 is accomplished by a support frame 22 which is attached to the head end of slant board 12. Support frame 22 may take any suitable form. In the embodiment illustrated in FIGS. 1–4 support frame 22 includes a pair of telescopic struts 24,26 which slide in a pivot collar 28 pivotally mounted to each support member 14. Thus, when slant board 12 is raised or lowered collar 28 pivots to permit support frame 22 to remain vertical, or to permit support frame 22 to change its angular orientation. In this manner the relative angle between the support frame 22 and slant board 12 may vary while the slant board and support frame remain attached to each other.

Figure 3:
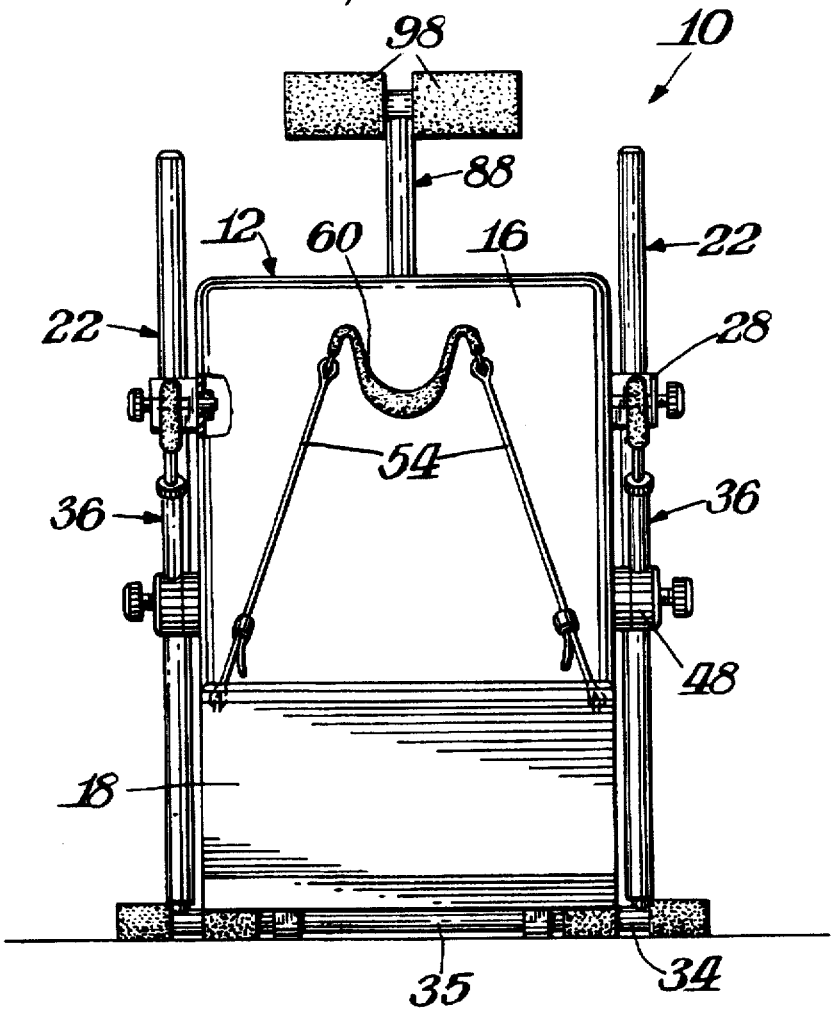
FIG. 3 is a left side elevational view of the device shown in FIGS. 1–2.

Slant board 12 is maintained in its various positions in any suitable manner. In the embodiment of FIGS. 1–4 this is accomplished by the use of one or more spring retainer pins 30 which are mounted to inner strut 26 and extend into a corresponding opening 32 in outer strut 24. Preferably the outer openings 32 are spaced apart by distances which would correspond to 5° or 10° increments in the corresponding angle of slant board 12. When inner strut 26 is fully extended slant board 12 is in a completely vertical position as shown in phantom in the left hand portion of 31. In this position various exercises could be done where the slant board acts as a back support. Conversely, when inner strut 26 is completely telescoped into outer strut 24 slant board 12 is completely horizontal as also shown in phantom in FIG. 1. A stability bar or foot 34 joins the lower ends of the strut members in frame 22 as best shown in FIG. 3. In order to compensate for the added height of the stability bar a similarly dimensioned bar or legs 35 are mounted to the foot end of slant board 12.

A further feature of this invention is the inclusion of rowing arm assemblies 36 on each side of slant board 12. Each rowing arm assembly 36 includes an outer tubular member 38 into which is telescopically mounted an inner member 40 to provide for length adjustment of each rowing arm. The amount of extension of inner tube 40 is controlled in any suitable manner such as by spring pin 42 attached to inner member 40 for being received in a selected opening 44 of outer member 38. The free end of each arm is padded by a foam handle 46.

In order to enhance the exercise value of rowing arm assemblies 36, each rowing arm is provided with some form of resistance. The preferred practice of this invention is to incorporate a friction brake 48 which is adjusted in the amount of friction offered to the pivotal movement of each rowing arm by tensioning knob 50. This form of adjustable friction resistance is of the type described in U.S. Pat. No. 5,207,622, the details of which are incorporated herein by reference thereto.

In the preferred practice of this invention the floor contacting surfaces of device 10 are padded so as to avoid scratching or causing damage to the floor. In this respect, stability bar 34 and front bar 35 are padded as illustrated, for example, in FIGS. 3–4.

During use of device 10 the user could lay on slant board 12 and the user's feet would be in contact with foot platform 18. After support frame 22 is manipulated to expose slant board 12 at the desired angle, the user would then perform a lower body exercise by moving toward and away from foot platform 18 while simultaneously performing an upper body exercise by rowing or pivoting the rowing arms 36.

As an advantageous supplement to the above type exercises, it is preferred to provide some form of assembly acting against the user's shoulders in a direction toward the foot platform. FIGS. 1–3 illustrate one form of shoulder resistance assembly 52 in the form of a pair of elastic resistance bands or cords 54 having their free or remote ends anchored to foot platform 18 at retainer eyes 56. An adjustable resistance retainer 58 controls the length of each band to thereby control the amount of resistance or urging force against the shoulders. The opposite ends of the bands 54 are connected to each other by a padded collar 60 which is disposed around the user's shoulders as shown in FIG. 1. The shoulder resistance assembly 52 thus functions as a U-shaped resistance member wherein the free ends are anchored and the intermediate portion is disposed behind the user's neck in contact with the user's shoulders.

Figure 5:
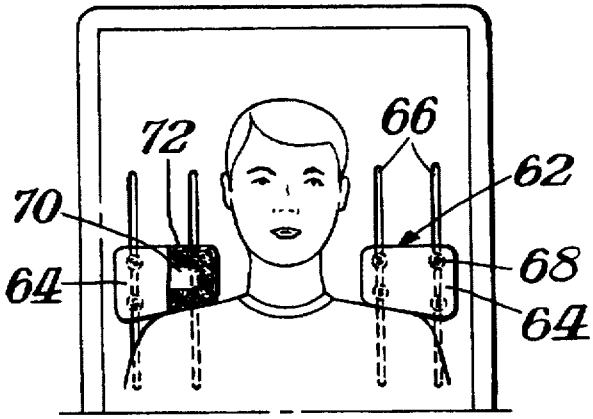
FIG. 5 is a partial top plan view showing an alternative form of the device of FIGS. 1–4.
Figure 4:
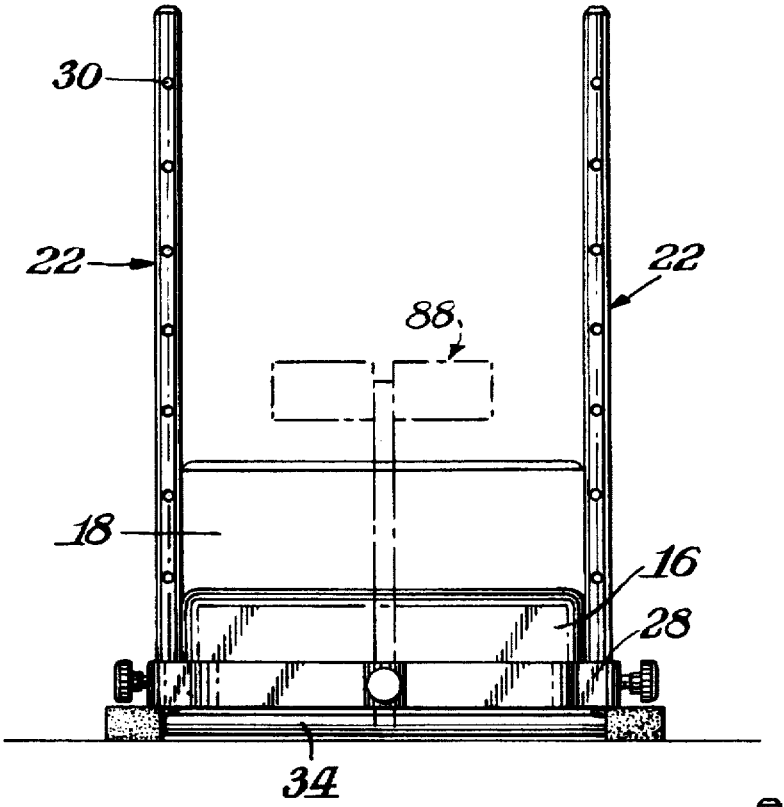
FIG. 4 is a right side elevational view of the device shown in FIGS. 1–3 with the slant board in its stored condition.

FIG. 5 illustrates an alterative form of shoulder resistance assembly 62. As shown therein a resistance pad 64 is mounted on each side of slant board 12 for being disposed against the user's shoulder. Each resistance pad 64 rides in a pair of slotted tracks 66 for movement up and down the resistance board 12 by means of guide pins 68 secured to each resistance pad 64 and disposed in a set of two parallel tracks 66. Each resistance pad 64 is preferably made of a padded material to which weights 70 are applied for urging the pads in a downward direction when slant board 12 is in any non-horizontal orientation. The weight could, for example, be located in the hollow interior of the resistance pad 64 with a cover 72 then concealing and housing the weights. If desired, cover 72 could be openable so as to permit the weights to be removed and replaced for varying the amount of resistance.

Figure 6:
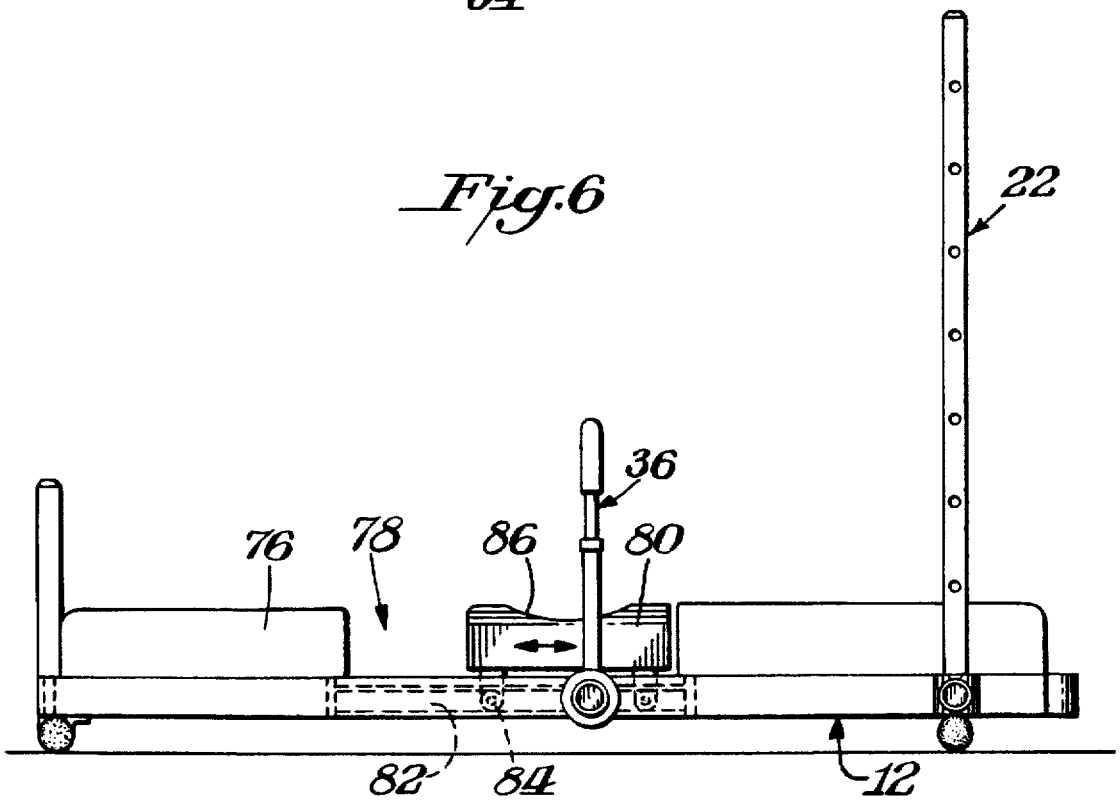
FIG. 6 is a side elevational view of yet another alternative device in accordance with this invention.
Figure 8:
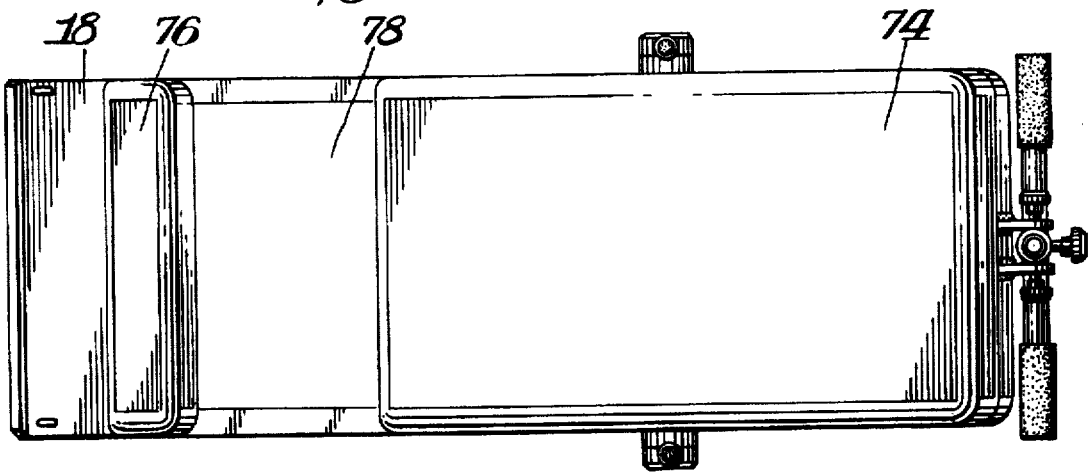
FIG. 8 is a top plan view of the device shown in FIG. 7.
Figure 7:
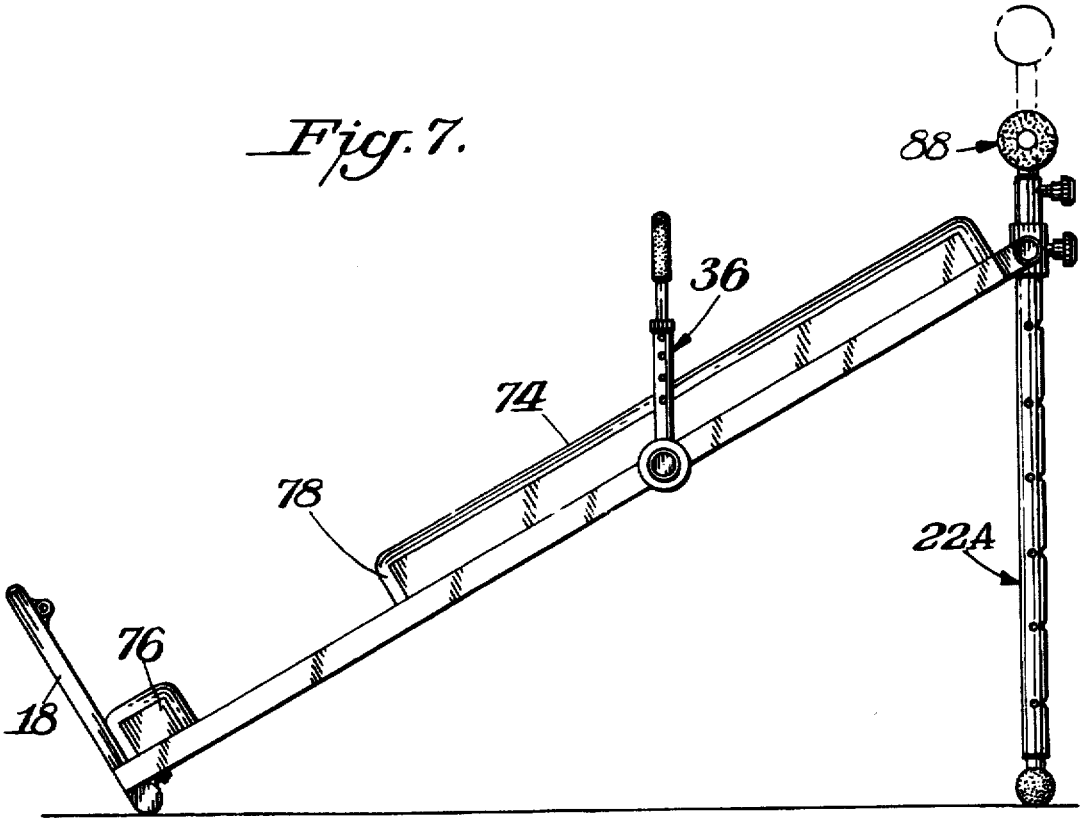
FIG. 7 is a side elevational view of a modified form of multiple exercise device in accordance with this invention.

FIG. 6 illustrates an alternative structure for the slant board. As shown therein instead of having the entire slant board padded, pads 74,76 may be provided at the head and foot end of the board 12. In this manner, particularly when the frame work of board 12 is simply a pair of parallel supports 14 there is an open space 78 over a portion of the board. The open space 78 is preferably located where the calves of the user's legs would be. Thus, the open space 78 could simply be of a size sufficient to correspond to the user's calves as shown in FIGS. 7–8. Alternatively, as shown in FIG. 6, the open space could be of a larger length and a padded carriage 80 could be provided which slides back and forth on tracks 82 by means of guide rollers 84 secured to carriage 80. Carriage 80 would have a depression 86 shaped for receiving the user's buttocks. In use of the embodiment of FIG. 6, as the user rows by pivoting the centrally located rowing arms 36, the user's upper body moves toward and away from foot board 18 as permitted by the sliding movement of carriage 80.

In order to enhance the versatility of device 10 slant board 12 may be provided with a sit up foot bar assembly 88 as illustrated in FIGS. 1–3. As shown therein the foot bar assembly 88 includes a post 90 which is slidably mounted in sleeve 92 and locked in its vertical extension position by knob 94 which could be a friction lock member or could have a pin which would be inserted into one of a series of appropriate openings in bar 90. Bar 90 has a cross member 96 extending outwardly from both sides of bar 90 with the free portions of cross bar 96 having padded sleeves 98 for comfort when the user contacts the sleeves or handles 98 in performing a sit up exercise. The sit up exercise could be done by placing the user's feet on the outer portion of padded members 98 where the user is in the position opposite that illustrated in FIG. 1. The sit up foot assembly could also be entirely removed from slant bar 12 when such exercise is not desired.

Figure 9:
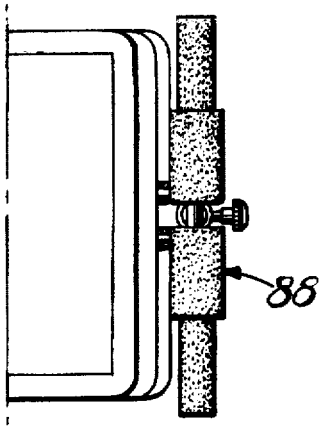
FIG. 9 is a fragmental top plan view of the device of FIG. 8.
Figure 11:
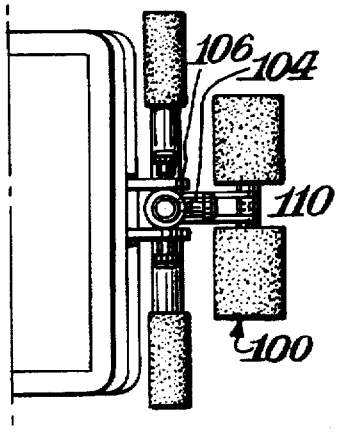
FIG. 11 is a fragmental top plan view of the device of FIG. 10.
Figure 10:
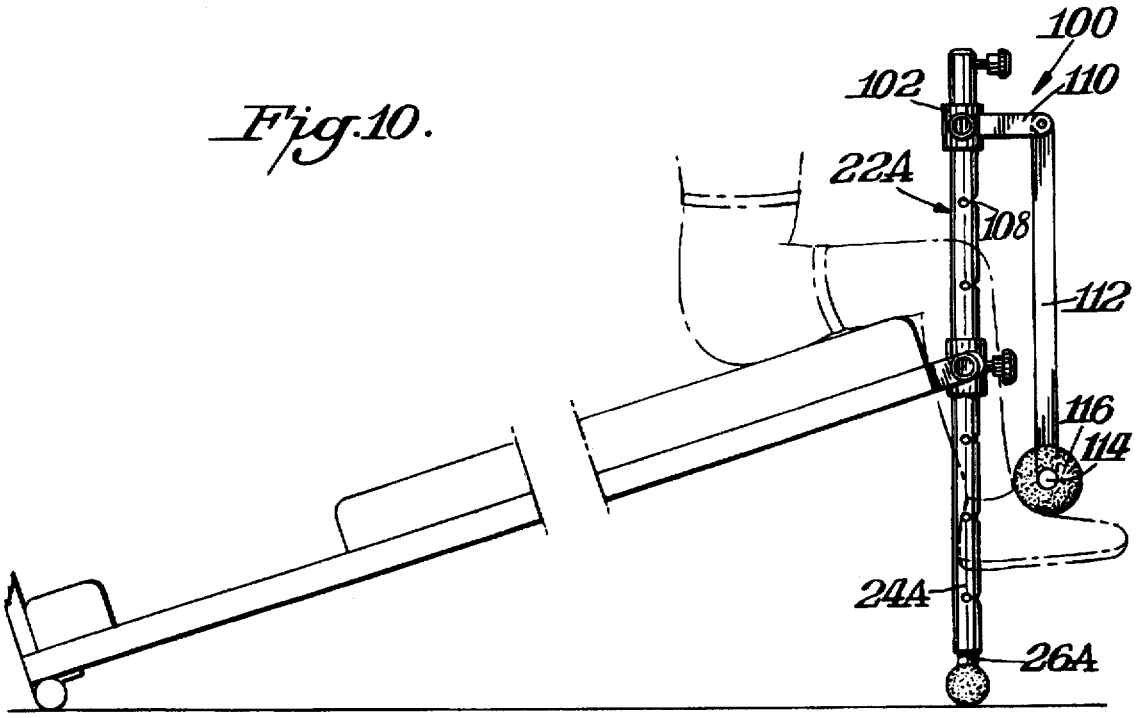
FIG. 10 is a side elevational view of the device of FIGS. 7–9 showing an alternative manner of using the device.

A further optional feature of device 10 is the inclusion of a sit up restraint assembly 100. As best illustrated in FIGS. 9–11. As shown therein restraint assembly 100 includes a collar 102 adjustably mounted on support frame 22A. Support frame 22A differs from support frame 22 in that frame 22A includes a single set of telescopic members 24A and 26A mounted to the end of slant board 12 rather than two sets of telescopic members of frame 22 where each set of members 24,26 is mounted to the sides of slant board 12 as previously described.

Collar 102 could be adjustably mounted in any suitable manner such as by the use of a locking member 104 having a pin 106 which extends into an appropriate opening 108 in the outer member 24A. Assembly 100 further includes a pair of horizontal arms 110 which are secured to collar 102. A vertical arm 112 is mounted between horizontal arms 110 and extends downwardly below slant board 12. A cross arm 114 is mounted at the lower free end of vertical arm 112 with the end portions having padded sleeves 116. Use of assembly 100 is shown in FIG. 10 where the user would sit on the end of slant board 12 with the user's legs disposed below padded extensions 116 and perform a sit up exercise with the padded extensions 116 acting as a restraint.

Although the various figures illustrate the support frame 22 or 22A to be mounted at one end of the slant board, it is to be understood that the invention may be practiced where any suitable elevating mechanism is mounted at any location on the slant board provided that the elevating mechanism or support frame will function to elevate one end of the slant board, thus the support frame or elevating mechanism could take any suitable structural form and could be located at any suitable portion of the slant board as long as it achieves the function of controlling the inclination of the slant board. It is preferred that such support frame or elevating mechanism include a stability bar, such as bar 34 which extends at least as far as and preferably beyond the limits of slant board 12 to minimize any tendency for side tipping of the slant board.

Figure 12:
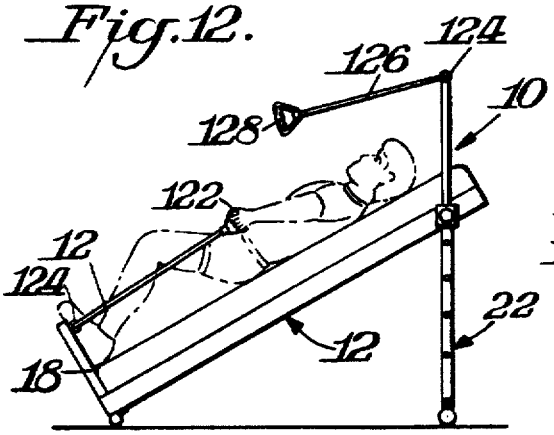
FIG. 12 is a side elevational view schematically showing an alternative form of the invention incorporating stretch cords.
Figure 13:
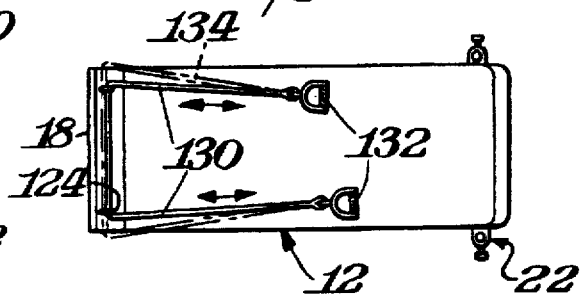
FIG. 13 is a top plan view of still yet another alternative form of the invention incorporating stretch cords.
Figure 14:
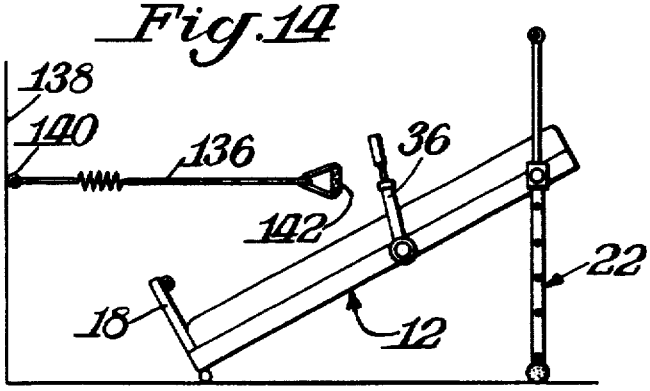
FIG. 14 is a side elevational view showing a modified form of the invention, including stretch cords and rowing arms.

In the preferred practice of the invention the arm exercise is achieved by means of rowing arms 36. The invention, however, may be practiced with alternative or additional arm exercise devices. FIG. 12, for example, shows the provision of stretch cords located with the handle portions within reach of the user's hands so that the user may pull the cords and stretch the cords. The cords would then tend to contract by their resilient nature and repetitively would be stretched and contracted in an arm exercise. Preferably, the stretch cords would be provided in pairs of cords which could be mounted at any suitable location, some of which are shown in FIGS. 12–14. Similarly, the stretch cords could be mounted in any suitable manner. What is essential is that the one end of each stretch cord should be anchored and the handle at the opposite end of the stretch cord should be located within reach of the user's hands.

FIG. 12 shows two possible locations for the stretch cords. One of the locations is to mount a pair of stretch cords 120 (only one of which is shown) with the ends anchored to the foot platform 18 so that the handles 122 would be located adjacent the waist of the user to be easily grasped by the user. The user would then pull upwardly to stretch the cords 120 and the cords would contract when the user's hands moving downwardly. The cords 120 may be individual cords each of which is anchored to foot platform 18 at loop or eyelet 124. Alternatively, a single stretch cord could be used which would pass through the eyelets 124 and the two free ends of the cord would be provided with handles 122.

A further location for the stretch cords is shown in FIG. 12 where the pair of stretch cords 126 (only one of which is shown) is mounted at the top of support frame 22 at one end thereof with the opposite end having a handle 128 which could be grasped by the user's hands. Stretch cords 126 would be used by the user pulling downwardly on the stretch cords 126 and then the user's arms would move upwardly as the cords 126 contract. It is to be understood that the illustration of the stretch cord 126 being mounted to frame 22 is for exemplary purposes. For example, the slant board illustrated in FIGS. 12–14 is only shown schematically and does not include the various other auxiliary devices such as the sit up foot assembly 88 of FIGS. 1–3 or the sit up restraint assembly 100 of FIGS. 10–11. The stretch cords could be mounted to either of those assemblies by the use of anchoring members or by having a single stretch cord looped around the structure of the assembly with each free end of the cord having a handle 128.

FIG. 13 shows the provision of a single stretch cord 130 extending through loops 124 of foot platform 18 with the free ends having handles 132.

FIG. 13 also illustrates in phantom an alternative mounting arrangement wherein the stretch cord 134 is simply looped around the foot platform 18 without any positive securement. If desired, however, guide members may be provided on the outer surface or back wall of the foot platform is to accommodate stretch cord 134.

FIG. 14 shows the provision of a stretch cord 136 anchored at one end to a wall 138 by means of suitable guide members, such as loops 140. The free end of stretch cord 136 is provided with a handle 142. In the preferred practice there would be two such free ends with two handles so that each handle is located along a respective side of the slant board 12. As with the other forms of stretch cords a pair of individual cords may be provided to result in the two free ends or a single cord could be used wherein a handle would be mounted at each free end of the single cord.

FIG. 14 also illustrates the practice of the invention where the slant board includes rowing arms 36 in addition to stretch cords.

It is to be understood that the illustrations in FIGS. 12–14 for the forms and locations of the stretch cords are merely exemplary. Thus, cords could be provided in addition to or as a replacement for the rowing arms. Cords could be provided physically anchored to the slant board or other assemblies mounted to the slant board. Cords could simply be looped around portions of the slant board such as the foot platform or cords could be mounted to structure not connected to the slant board. In all of these variations there would be some form of anchoring of the cord at a location remote from the user's hands and the cords would have a free end disposed at the user's hands, preferably with two such free ends being provided, one on each side of the slant board so that the user could pull upwardly or pull downwardly in opposition to the resiliency of the stretch cord and thereby achieve an arm exercise generally similar to that obtained by use of the rowing arms 36.

In various practices of the invention where the user is intended to slide longitudinally on the slant board during an exercise the sliding movement may be facilitated by providing some low friction material such as a chamois cloth or a plastic sheet on the support surface such as pad 16 of slant board 12.

It is to be understood that various features shown in individual embodiments may be incorporated in other embodiments herein within the spirit of this invention.

What is claimed is:

1. A multiple exercise device comprising an elongated slant board for supporting the body of a user, a support frame mounted to said slant board for elevating one end of said slant board to a plurality of selected positions to vary the inclination of said slant board, an arm exercise assembly, said arm exercise assembly including an elongated member at each side of said slant board, said elongated member including an anchored end and a free end, said free end terminating in a handle at its respective side of said slant board for being grasped by the user during an arm exercise wherein the user moves the arms of the user back and forth while each arm of the user holds a respective one of said handles, a resistance force acting on said elongated members in opposition to manual movement of said elongated members by the user grasping and moving said handles, said one end of said slant board being the head end of said slant board and the opposite end of said slant board being the foot end with a body supporting surface therebetween, at least one foot board mounted to said foot end and extending substantially perpendicularly outwardly from said body support surface to provide an upstanding member against which the feet of the user may be disposed, a sit up bar assembly mounted to said head end for said slant board, said sit yp bar assembly including a horizontal bar mounted above said slant board and said horizontal bar being separate and distinct from said support frame.

2. The device of claim 1 wherein said arm exercise assembly comprises a rowing arm assembly mounted on opposite sides of said slant board, each of said rowing arm assemblies including a rowing arm pivotally mounted to said slant board, and said resistance force resulting from a resistance assembly acting against each of said rowing arms to resist the pivoting motion to each of said rowing arms to provide an upper body exercise when the user grasps and pivots said rowing arms.

3. The device of claim 1 including a longitudinally movable shoulder resistance assembly mounted to said slant board for contacting the shoulders of the user and applying a force against the shoulders.

4. The device of claim 3 wherein said shoulder resistance assembly includes elastic bands mounted to said foot board, and a collar interconnecting said bands for being placed against the shoulders of the user and urged by said elastic bands toward said foot board.

5. The device of claim 3 wherein said shoulder resistance assembly includes a pair of spaced weighted pads slidably mounted to said slant board.

6. The device of claim 1 wherein a stretch cord assembly is provided having a pair of free ends each of which is disposed generally adjacent to said handles with said stretch cord assembly being anchored at a location remote from said free ends.

7. A multiple exercise device comprising an elongated slant board for supporting the body of a user, a support frame mounted to said slant board for elevating one end of said slant board to a plurality of selected positions to vary the inclination of said slant board, an arm exercise assembly, said arm exercise assembly comprising a rowing arm assembly mounted on opposite sides of said slant board, each of said rowing arm assemblies including a rowing arm having an anchored end pivotally mounted to said slant board, each of said rowing arms having a free end terminating in a handle at its respective side of said slant board for being grasped by the user during an arm exercise wherein the user moves the arms of the user back and forth while each arm of the user holds a respective one of said handles, a resistance force acting on said elongated members in opposition to manual movement of said elongated members by the user grasping and moving said handles, said resistance force resulting from a resistance assembly acting against each of said rowing arms to resist the pivoting motion to each of said rowing arms to provide an upper body exercise when the user grasps and pivots said rowing arms said support frame varying the positions of said slant board between a substantially vertical position and a substantially horizontal position said support frame including at least one set of telescopic struts pivotally mounted to said slant board, and locking members for locking said struts together at selected positions of said slant board.

8. The device of claim 7 wherein said support frame includes a set of said struts on each side of said slant board, and a horizontal foot interconnecting said sets of struts.

9. The device of claim 7 including a shoulder resistance assembly mounted to said slant board for contacting the shoulders of the user and applying a force against the shoulders.

10. The device of claim 9 wherein said one end of said slant board being the head end of said slant board and the opposite end of said slant board being the foot end with a body supporting surface therebetween, at least one foot board mounted to said foot end and extending substantially perpendicularly outwardly from said body support surface to provide an upstanding member against which the feet of the user may be disposed, said shoulder resistance assembly including elastic bands mounted to said foot board, and a collar interconnecting said bands for being placed against the shoulders of the user and urged by said elastic bands toward said foot board.

11. The device of claim 9 wherein said shoulder resistance assembly includes a pair of spaced weighted pads slidably mounted to said slant board.

12. The device of claim 7 including a sit up bar assembly mounted to one end of said slant board, and said sit up bar assembly including a horizontal bar mounted above said slant board.

13. The device of claim 12 wherein said horizontal sit up bar is detachably mounted to said slant board and is adjustably mounted to vary the distance said sit up bar is disposed above said slant board.

14. the device of claim 7 including a sit up restraint assembly mounted to one end of said slant board, and said sit up restraint assembly including a horizontally disposed bar disposed below said slant board.

15. The device of claim 14 wherein said horizontally disposed sit up bar is detachably mounted to said slant board and is adjustably mounted to vary the distance said sit up bar is disposed below said slant board.

16. The device of claim 7 wherein said slant board has padding at each of its ends with an open area between said paddings whereby the calves of the legs of the user are unsupported at said open area.

17. The device of claim 16 including a carriage slidably mounted in said open area for supporting the buttocks of the user.

18. A multiple exercise device comprising an elongated slant board for supporting the body of a user a support frame mounted to said slant board for elevating one end of said slant board to a plurality of selected positions to vary the inclination of said slant board, an arm exercise assembly, said arm exercise assembly including an elongated member at each side of said slant board, said elongated member having an anchored end and a free end, said free end terminating in a handle at its respective side of said slant board for being grasped by the user during an arm exercise wherein the user moves the arms of the user back and forth while each arm of the user holds a respective one of said handles, a resistance force acting on said elongated members in opposition to manual movement of said elongated members by the user grasping and moving said handles, and said slant board having padding at each of its ends with an open area between said paddings whereby the calves of the legs of the user are unsupported at said open area.

19. The device of claim 18 including a carriage slidably mounted in said open area for supporting the buttocks of the user.

20. A multiple exercise device comprising an elongated slant board for supporting the body of a user, said slant board having opposite ends interconnected by opposite sides, a support frame mounted to said slant board for elevating one of said ends of said slant board to a plurality of selected positions to vary the inclination of said slant board, an arm exercise assembly, said arm exercise assembly including an elongated member at each side of said slant board, said elongated member included an anchored end and a free end, said free end terminating in a handle at its respective side of said slant board, said handles being selectively located generally midway between said opposite ends of said slant board for being grasped by the user during an arm exercise wherein the user moves the arms of the user back and forth while each arm of the user holds a respective one of said handles, a resistance force acting on said elongated members in opposition to manual movement of said elongated members by the user grasping and moving said handles, a shoulder resistance assembly mounted to said slant board for contacting the shoulders of the user said shoulder resistance assembly including shoulder contacting surfaces located inwardly of said sides of said slant board and longitudinally movable in a direction generally parallel to said sides of said slant board for applying a force against the shoulders of the user while the user is on said slant board.

21. The device of claim 20 wherein said arm exercise assembly comprises a rowing arm assembly mounted on opposite sides of said slant board, each of said rowing arm assemblies including a rowing arm pivotally mounted to said slant board, and said resistance force resulting from a resistance assembly acting against each of said rowing arms to resist the pivoting motion to each of said rowing arms to provide an upper body exercise when the user grasps and pivots said rowing arms.

22. The device of claim 20 wherein said shoulder resistance assembly includes elastic bands mounted to said foot board, and a collar interconnecting said bands for being placed against the shoulders of the user and urged by said elastic bands toward said foot board.

23. The device of claim 20 wherein said shoulder resistance assembly includes a pair of spaced weighted pads slidably mounted to said slant board.

24. The device of claim 20 wherein a stretch cord assembly is provided having a pair of free ends each of which is disposed generally adjacent to said handles with said stretch cord assembly being anchored at a location remote from said free ends.

25. The device of claim 20 wherein said one end of said slant board is the head end of said slant board and the opposite end of said slant board is the foot end with a body supporting surface therebetween, and at least one foot board mounted to said foot end and extending substantially perpendicularly outwardly from said body support surface to provide an upstanding member against which the feet of the user may be disposed.

26. The device of claim 25 wherein said foot board comprises a single board extending substantially across said foot end, said foot board being detachably mounted to said slant board, and said foot board being adjustably mounted to said slant board to vary the amount of extension of said foot board with respect to said body support surface.

27. The device of claim 20 wherein said elongated member of said arm exercise assembly comprises a stretch cord.

28. A multiple exercise device comprising an elongated slant board for supporting the body of a user, a support frame mounted to said slant board for elevating one end of said slant board to a plurality of selected positions to vary the inclination of said slant board, an arm exercise assembly, said arm exercise assembly comprising a rowing arm assembly mounted on opposite sides of said slant board, each of said rowing arm assemblies including a rowing arm having an anchored end pivotally mounted to said slant board, each of said rowing arm assemblies including a rowing arm having an anchored end pivotally mounted to said slant board, each of said rowing arms having a free end terminating in a handle at its respective side of said slant board for being grasped by the user during an arm exercise wherein the user moves the arms of the user back and forth while each arm of the user holds a respective one of said handles, a resistance force acting on said elongated members in opposition to manual movement of said elongated members by the user grasping and moving said handles, said resistance force resulting from a resistance assembly acting against each of said rowing arms to resist the pivoting motion to each of said rowing arms to provide an upper body exercise when the user grasps and pivots said rowing arms, a stretch cord assembly is provided having a pair of free ends each of which terminates generally adjacent to said handles of said rowing arms with said stretch cord assembly being anchored at a location remote from said free ends.

29. The device of claim 28 wherein said one end of said slant board is the head end of said slant board and the opposite end of said slant board is the foot end with a body supporting surface therebetween, and at least one foot board mounted to said foot end and extending substantially perpendicularly outwardly from said body support surface to provide an upstanding member against which the feet of the user may be disposed.

30. The device of claim 29 including a longitudinally movable shoulder resistance assembly mounted to said slant board for contacting the shoulders of the user and applying a force against the shoulders.

31. The device of claim 30 wherein said shoulder resistance assembly includes elastic bands mounted to said foot board, and a collar interconnecting said bands for being placed against the shoulders of the user and urged by said elastic bands toward said foot board.

32. The device of claim 30 wherein said shoulder resistance assembly includes a pair of spaced weighted pads slidably mounted to said slant board.

33. The device of claim 28 including a longitudinally movable shoulder resistance assembly mounted to said slant board for contacting the shoulders of the user and applying a force against the shoulders.

34. A multiple exercise device comprising an elongated slant board for supporting the body of a user, a support frame mounted to said slant board for elevating one end of said slant board to a plurality of selected positions to vary the inclination of said slant board, an arm exercise assembly, said arm exercise assembly including an elongated member at each side of said slant board, said elongated member having an anchored end and a free end, said free end terminating in a handle at its respective side of said slant board for being grasped by the user during an arm exercise wherein the user moves the arms of the user back and forth while each arm of the user holds a respective one of said handles, a resistance force acting on said elongated members in opposition to manual movement of said elongated members by the user grasping and moving said handles, said one end of said slant board being the head end of said slant board and the opposite end of said slant board being the foot end with a body supporting surface therebetween, at least one foot board mounted to said foot end and extending substantially perpendicularly outwardly from said body support surface to provide an upstanding member against which the feet of the user maybe disposed, and a stretch cord assembly being provided having a pair of free ends each of which terminates generally adjacent to said handles of said elongated members with said stretch cord assembly being anchored at a location remote from said free ends.

35. The device of claim 34 wherein said arm exercise assembly comprises a rowing arm assembly mounted on opposite sides of said slant board, each of said rowing arm assemblies including a rowing arm pivotally mounted to said slant board, and said resistance force resulting from a resistance assembly acting against each of said rowing arms to resist the pivoting motion to each of said rowing arms to provide an upper body exercise when the user grasps and pivots said rowing arms.

36. The device of claim 34 including a longitudinally movable shoulder resistance assembly mounted to said slant board for contacting the shoulders of the user and applying a force against the shoulders.

37. The device of claim 36 wherein said shoulder resistance assembly includes elastic bands mounted to said foot board, and a collar interconnecting said bands for being placed against the shoulders of the user and urged by said elastic bands toward said foot board.

38. The device of claim 36 wherein said shoulder resistance assembly includes a pair of spaced weighted pads slidably mounted to said slant board.

* * * * *